United States Patent [19]

Knappstein

[11] 4,024,024

[45] May 17, 1977

[54] HOPPER FOR PREDRIED FINE COAL CARRIED ON HOPPER TRUCKS FOR COKING BATTERIES

[75] Inventor: Johannes Knappstein, Spanenkamp, Germany

[73] Assignee: Firma Carl Still, Germany

[22] Filed: Mar. 30, 1976

[21] Appl. No.: 671,834

[30] Foreign Application Priority Data

Apr. 10, 1975 Germany ..... 2515583

[52] U.S. Cl. ..... 202/262

[51] Int. Cl.[2] ..... C10B 31/04

[58] Field of Search ..... 202/262, 263, 251; 259/DIG. 17, 4 R; 214/18 PH, 35 R

[56] References Cited

UNITED STATES PATENTS

| | | | |
|---|---|---|---|
| 1,855,191 | 4/1932 | King | 202/262 X |
| 2,244,195 | 6/1941 | Hasselbach | 259/DIG. 17 |
| 2,609,185 | 9/1952 | Eisner | 259/DIG. 17 |
| 2,793,176 | 5/1957 | Wassermann et al. | 202/251 |
| 3,511,391 | 5/1970 | Tucker | 202/262 X |
| 3,648,985 | 3/1972 | Matweecha | 259/4 R |
| 3,675,797 | 7/1972 | Pries et al. | 202/263 X |
| 3,753,867 | 8/1973 | Wiemer | 202/262 |

*Primary Examiner*—Joseph Scovronek
*Assistant Examiner*—Arnold Turk
*Attorney, Agent, or Firm*—McGlew and Tuttle

[57] ABSTRACT

A hopper for predried fine coal for use with a coke oven battery or a plurality of batteries arranged in a row, comprises a wheeled support truck which is adapted to be moved along over the top of the oven batteries. A fine coal hopper is mounted on the truck and it includes a bottom discharge to facilitate discharging of the fine coal therethrough into the individual batteries. An inert gas system is connected to the fine coal hopper and it includes an inert gas distributor located alongside the hopper on the truck, and includes nozzles directed at a plurality of locations around the periphery and along the height of the fine coal hopper into the hopper and the fine coal contained therein. The hopper is closed by a hood which includes a hood drain connected through an inert gas return line to a plurality of filters where the coarse particles are removed and fed to a source for using the coarse coal particles and the inert gases are again returned to a compressor, along with a fresh supply of inert gases, which discharges into a pressure storage tank. The pressure storage tank is connected through an inert gas feedline to the distributor. In one embodiment, the inert gas feed and return line comprises an extensible, flexible connection, which is effected by the use of a small wheeled carriage containing a windup reel which moves inwardly and outwardly in respect to the fine coal hopper to accommodate the slack between the hopper and the inert gas system which is located at a fixed station. In another embodiment, the inert gas system, which includes filters for filtering the return inert gases, and a compressor for compressing the gases along with a fresh supply of inert gas and delivering it to a pressure storage tank mounted on a carriage which also moves along with the hopper and is coupled to the hopper truck.

9 Claims, 4 Drawing Figures

HOPPER FOR PREDRIED FINE COAL CARRIED ON HOPPER TRUCKS FOR COKING BATTERIES

FIELD AND BACKGROUND OF THE INVENTION

This invention relates in general to the construction of coke oven charging devices and in particular to a new and useful device for delivering fine coal to each oven of a coke oven battery, and which includes a truck for the coal hopper which is movable along the batteries and which is connected to an inert gas pressure system, for distributing inert gases throughout the fine coal hopper, and for returning and filtering the gases.

DESCRIPTION OF THE PRIOR ART

It has been known to employ hopper trucks which are movable along the coke oven batteries for positioning coal hoppers so that they may discharge into each battery oven in succession. Such trucks have also been equipped with funnel-shaped transfer elements suspended in a pendulum fashion, and having an automatic locking mechanism for the special locking element which is arranged in the transfer funnel and which is designed as a rotary slide valve. When such hoppers are used for fine coal, however, which has been predried by heating or in any other way, it was found that the loose coal charge in the hoppers becomes so compressed by jarring and jolting during the ride of the hopper truck along the battery that the coal will not flow freely outwardly through the blocking element and the transfer elements into the furnace chambers. This prevents the rapid and complete emptying of the hoppers and the formation of agglomerates or lumps and bridges. To overcome these disadvantages, mechanical devices such as pokers are installed in the hoppers to break up the fragments and agglomerates and to aid in the outflow of the coal. It has been found in practice, however, that such devices are only locally effective, and they cannot be employed to service an entire hopper system, without a specially engineered design which would require vast outlays and instructional course. Other devices such as jarring devices and tappers which are arranged on the outside of a hopper wall cannot solve the problem either, because they have a tendency to counterract the loosening of the fine coal and in fact cause compacting and lumping thereof.

SUMMARY OF THE INVENTION

In accordance with the present invention, there is provided a hopper which is supplied with inert gases which are directed into the hopper at spaced locations around the periphery and throughout the height in a quantity to maintain the fine coal fluid and flowable, and despite vibrations and the riding of the hopper truck along the battery cover. For this purpose the hopper carries a plurality of ring conduits around its circumference, which are connected to individual nozzles which discharge at spaced locations along the entire height of the hopper. Thus an inert gas charge is continuously forced through the coal charge during the ride along the battery cover.

The special effect of fully maintaining the fluidity and flowability of the finely ground predried coal even after vibrations and during transportation in the hopper, is accounted for theoretically by the assumption that the individual coal particles are surrounded by a gas envelope and the particles are in contact in the charge, not with each other, but with their gas envelopes. In this manner, the charge has originally an extremely low internal friction, which corresponds practically to that of the enveloping gas. Under the hard vibrations during the transportation in the hoppers to the furnace chambers to be filled, the gas envelopes collapse and the coal particles move closer together, and increase the specific weight of the charge and its internal friction, so that the formation of agglomerates is enhanced, which hinder the free and regular discharge of the coal during the filling of the furnace chambers. By injecting inert gas in the form of very fine current paths into the hoppers from the bottom to the top, the gas envelopes of the individual particles are built up again and again when they threaten to collapse. The coal charge in the hopper therefore maintains its original flowability and fluidity.

The fact that the bulk weight is lower than that of a normal charge due to the gas portions of the charge, can be taken into account by providing the hopper with a 10-20% greater volume than normal.

The gas distributing means for distributing inert gases throughout the hoppers advantageously comprises nozzles or bodies of porous ceramic or metallic material, the latter being particularly effective since they split the gas current into particularly fine current paths. The sockets are advantageously arranged, preferably on the circumference of the hopper wall in regular horizontal and vertical intervals, and all sockets arranged on a circumference are connected to a common inert gas supply line or to an inert gas station.

The ring conduits which surround the hoppers are connected with the inert gas supply line through branch lines in which are installed pressure regulators, so that the inert gas pressure of the ring conduits at the various levels can be set so that the pressure is highest for the bottom-most ring conduit and lowest for the topmost ring conduit.

The inert gas issuing from the hopper contains dust particles from the coal, and this gas is collected in a hood over the top of the hopper which has a drain connection leading to a filter plant of an inert gas system. The dust is separated from the inert gases before any gas is discharged into the atmosphere. The inert gas can also be recirculated, together with a fresh supply, after it has been passed through the filters. In this manner the expenses are reduced to a minimum.

The inert gas feed and the gas drain can advantageously be connected to an inert gas station which consists of a filter plant for the gas issuing from the hopper, a suction draft blower, a compressor and a pressure storage tank. The pressure storage tank is designed as a round tank with a conical bottom part. Into the upper part is introduced the compressed, inert gases, which are withdrawn from it for supplying them to the individual hoppers. Dust particles which have been carried along settle in the lower cone portion of the storage pressure tank and can be discharged through a grate and combined with the dust from the filters which may, for example, be burned in other devices.

In one embodiment the filter and compression plant for the inert gas is arranged directly on the truck carrying the hopper or on a separate truck which is coupled thereto. It can also be located at a stationary location, in the proximity of the coal tower, and a connection may be established between the hopper truck and the inert gas station which includes a windable or flexible wide hoses or other flexible connections to permit the movement of the truck away from the station and backward again.

The inert gas advantageously comprises an incombustible gas such as nitrogen or carbon dioxide. Flue gases or generally exhaust gases can also be used, provided their temperature and their oxygen content are low enough. When using flue gases as inert gas, an oxygen recorder can be arranged in the fresh gas pipe to the compressor, which cooperates with a relay control closing valve in the feedpipe. In this way the flue gases, with a substantial oxygen content, are positively prevented from getting into the storage pressure tank to be used as an inert gas, and thus this would eliminate the possibility of igniting the coal under certain circumstances, or otherwise damaging the plant. Gas escaping from the empty furnace chambers during filling, which has no appreciable oxygen content, can also be used as an inert gas which may be directed into the fine coal hopper. To this end the elements for transferring the coal from the hoppers of the hopper truck to the furnace chambers are provided with a connecting line to the inert gas circulation, and the transfer elements are provided with a filler cap which is narrower in its cross-section than the hopper. In addition, they are provided with a tubular shell of the diameter of the hoppers, so that the gases can escape into the outer torus formed by the filler cap and the tubular shell. The gases are liberated of their own tar components in a detarring apparatus.

Accordingly it is an object of the invention to provide an apparatus for supplying predried fine coals to individual ovens of a coke oven battery, which includes a truck having a fine coal hopper thereon and with means for directing an inert gas into the hopper at spaced locations around its periphery and throughout the height of the hopper, and which are connected to an inert gas pressure storage means, which may advantageously be located either at a fixed station or moved along with the hopper.

A further object of the invention is to provide an apparatus for maintaining fine coal in a condition in which it may be easily distributed into a plurality of coke ovens of a battery, and which includes a connection to a hopper for fine coal for supplying inert gas thereto at selected pressures along its height.

A further object of the invention is to provide an apparatus for supplying fine coal to individual ovens of a coke oven battery, which is simple in design, rugged in construction and economical to manufacture.

GENERAL DESCRIPTION OF THE PREFERRED EMBODIMENTS

Figure 1:
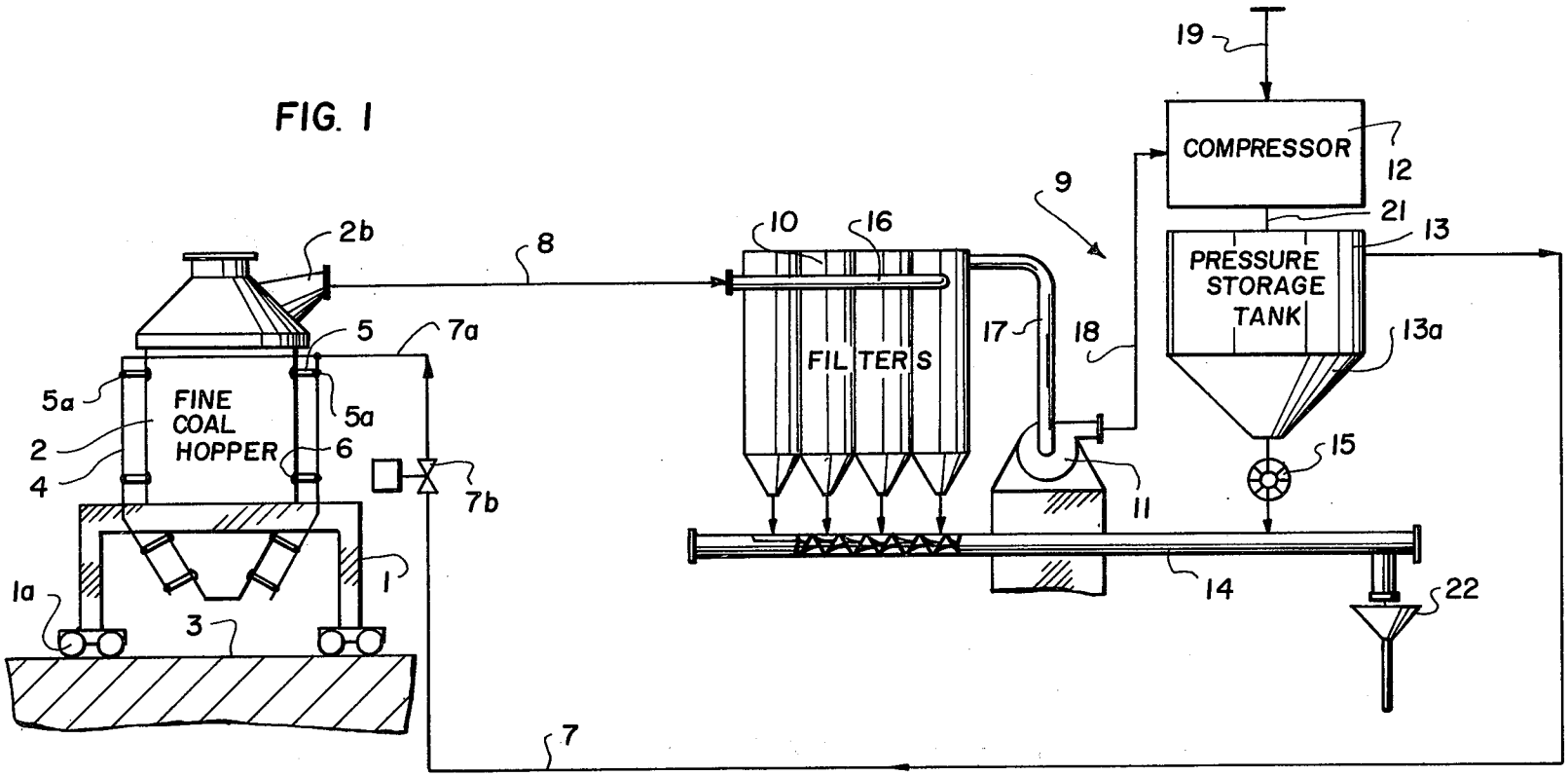
FIG. 1 is a schematic side elevational view of a hopper truck having a hopper constructed in accordance with the invention, and which is associated with an inert gas system.

Referring to the drawings in particular, the invention embodied therein in FIG. 1 comprises a truck or undercarriage 1 having wheels 1*a* to permit it to be moved along a coke oven battery cover 3, that provides a mounting for a fine coal hopper 2 which is constructed in accordance with the invention.

Figure 4:
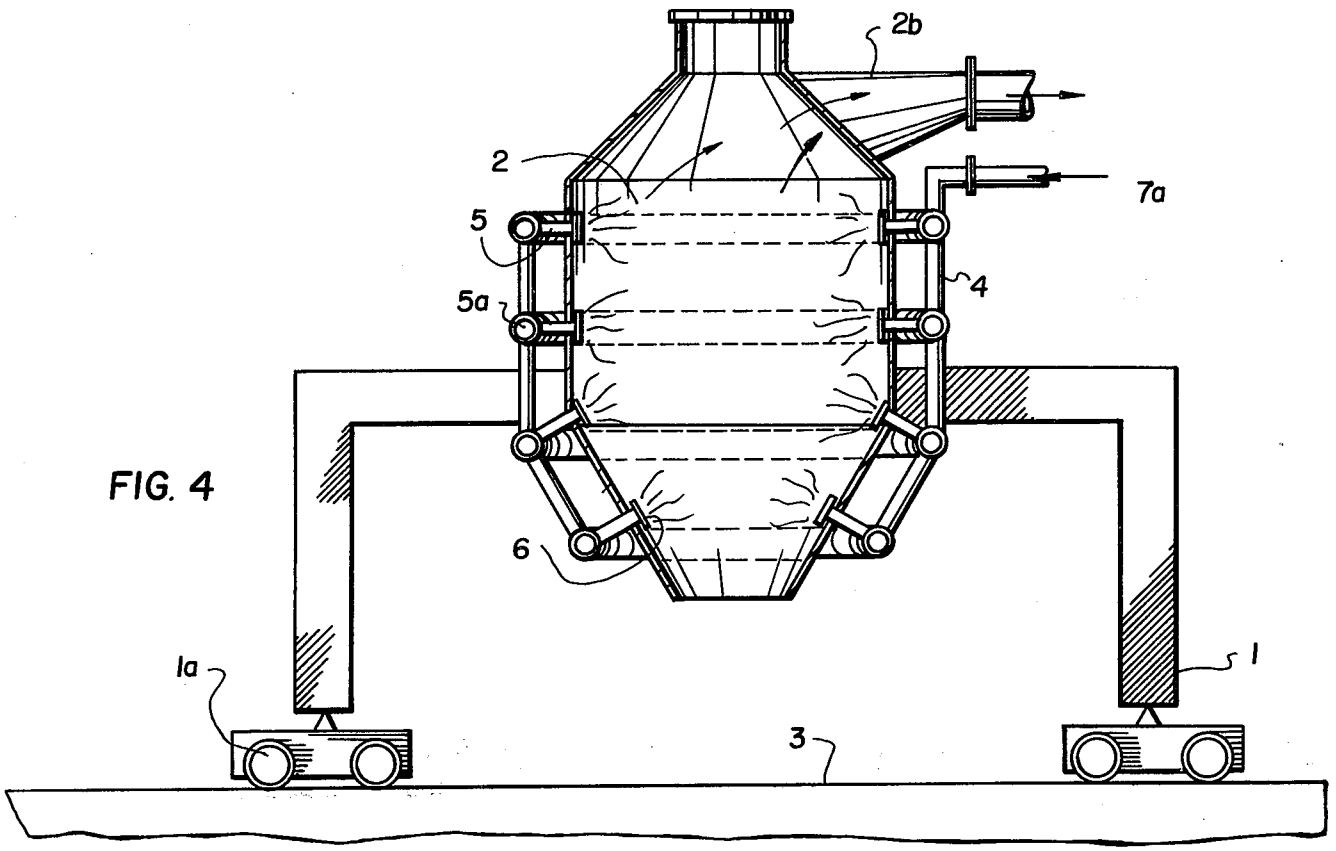
FIG. 4 is an enlarged side elevation of the hopper constructed in accordance with the invention.

In accordance with the invention the hopper 2 is provided with inert gas distributor means for directing an inert gas into the hopper at spaced locations around its circumference, and throughout its height. The inert gas distributor means includes a plurality of vertically spaced ring conduits (see FIG. 4) which are connected either separately or conjointly to a connecting line 7*a* through a feed pipe 4 for supplying the conduits with an inert gas from an inert gas system or supply generally designated 9. The supply of inert gas is regulated by a valve control 7*b* which is advangtageously located in each connection to each ring conduit 5*a*. A plurality of radially extending and circumferentially spaced sockets or delivery lines 5 pass through the wall of the hopper 2 and they carry at their inner ends nozzle attachment 6 for spraying the inert gas into the fine coal hopper 2. The inert gases are collected in a hood 2*a* covering the hopper 2, which has a hood drain connection 2*b* leading to a return line 8 for the return gases.

In accordance with a feature of the invention, inert gas station 9 may be at a fixed location, and in such event as indicated in FIG. 1, the inert gas supply line 7 and the return line 8 comprise flexible connections, which may be paid out or collected in accordance with the movement of the truck or undercarriage 1 away from or toward the inert gas station 9.

The inert gas station comprises an inert gas system which includes a feed duct 16 connected to the inert gas return line 8 and provided for distributing the gases into individual filters 10 where the dust particles are removed from the gas and delivered downwardly into a conveyor 14. The filters 10 can be of ceramic metal or textile material. Purified inert gas is withdrawn through the line 17 by a suction pump or blower 11 and fed through line 18 to a compressor 12. The compressor 12 has a discharge 21 connected into a pressure storage tank 13, and it effects compression of the inert gas to from 5–10 atmospheres, for example. Any dust particles which may be carried along can settle in the bottom conical section 13*a* of the storage tank 13 and they are delivered through a discharge gate 15 where they join with the dust particles from the filter 10 and are delivered to a discharge funnel 22 for use at another location, for example for burning in a steam generator. Fresh inert gas is supplied to the compressor 12 through a socket 19.

Figure 2:
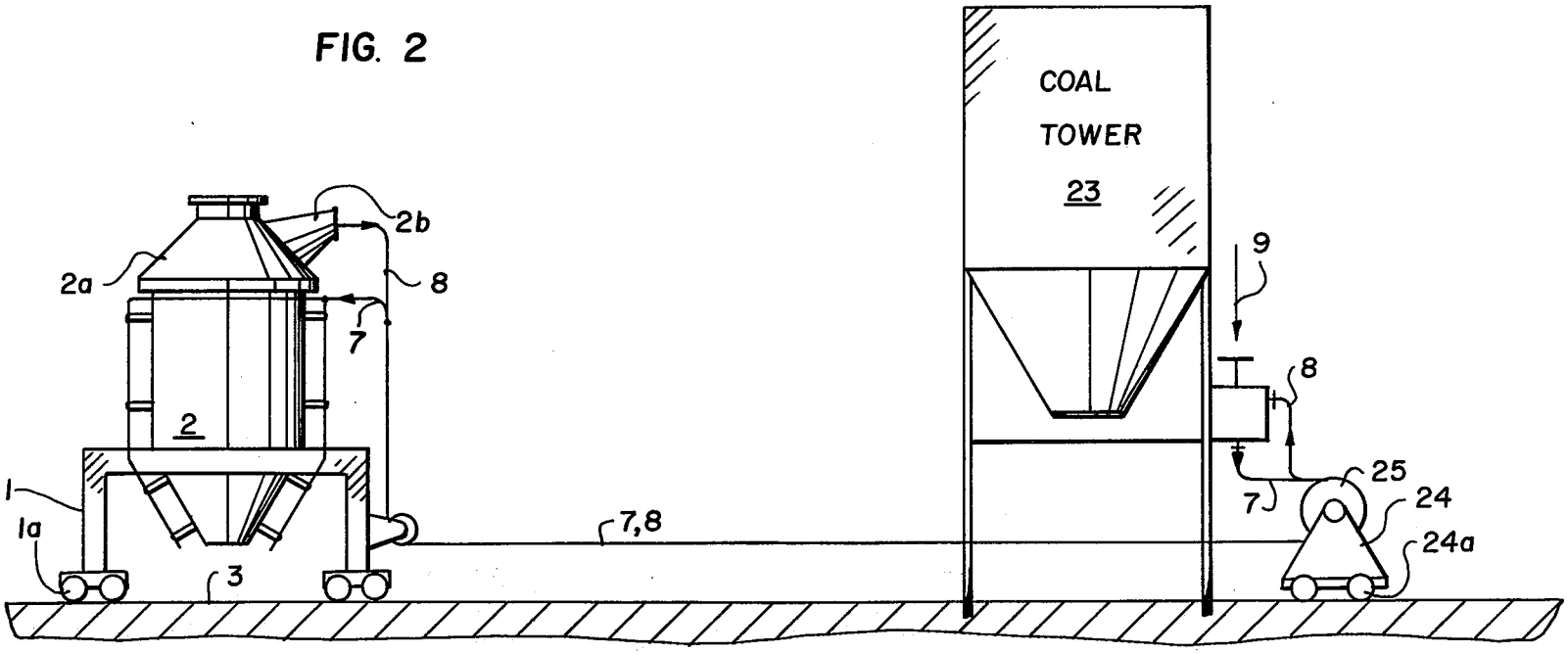
FIG. 2 is a schematic representation similar to FIG. 1 of another embodiment of the invention.

The embodiment shown in FIG. 2 is substantially the same as that in FIG. 1, but it shows a specific arrangement for handling the flexible connection lines 7 and 8, using a small carriage 24 which moves along the oven battery cover 3 on wheels 24*a*. Carriage 24 moves backwardly and forwardly to deflect the flexible connections 7 and 8 over a drum 25 and take up any slack between the connections and the movable truck 1. In the embodiment of FIG. 2 the inert gas system 9 is shown as being attached to a coal tower 23 at a fixed station. Coal tower 23 may provide means for supplying the individual hoppers 2 with a fresh charge.

Figure 3:
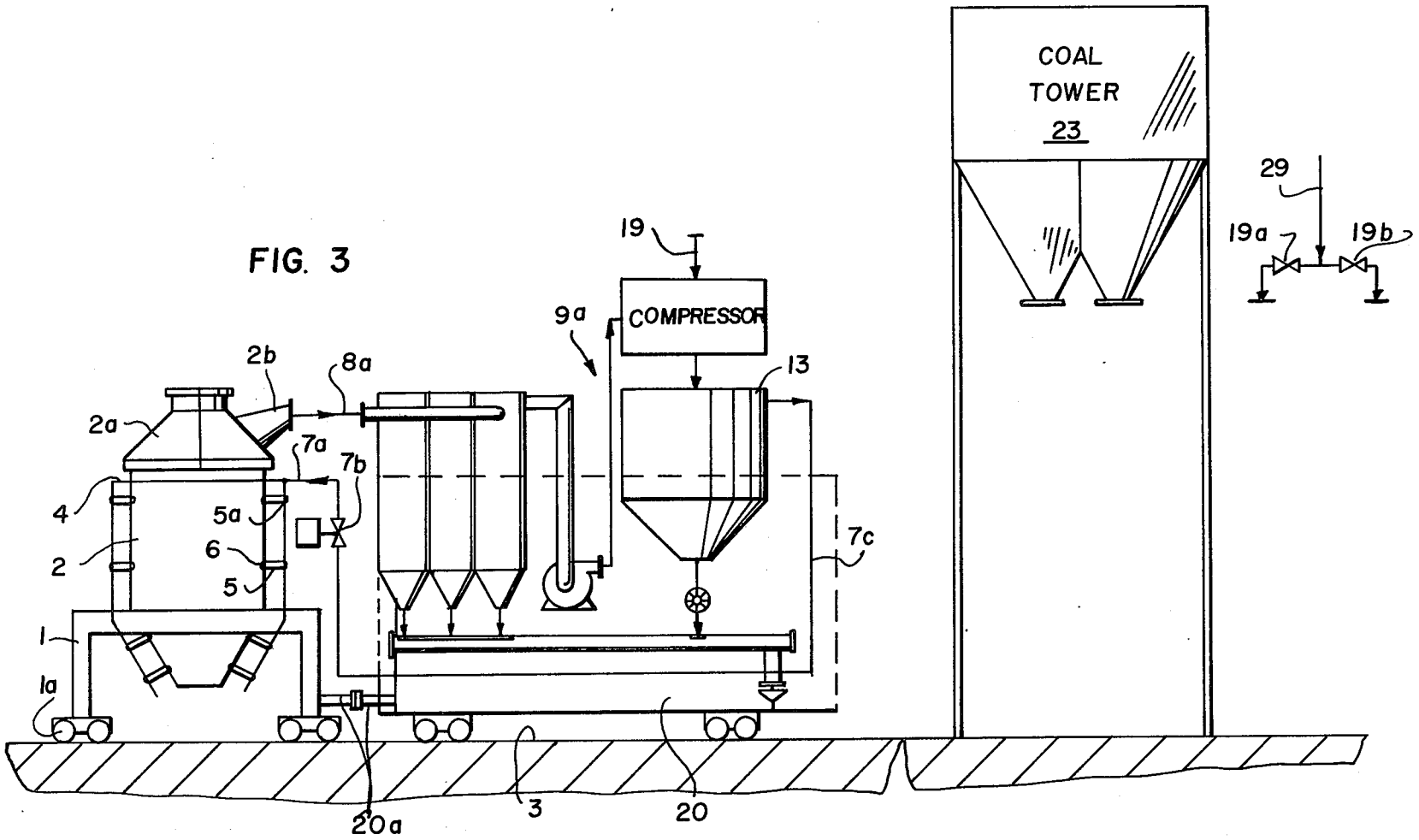
FIG. 3 is a view similar to FIG. 1 of still a further embodiment of the invention.

In FIG. 3 an arrangement is shown where inert gas system 9*a* is mounted on its own wheeled carriage for truck 20 so that it may be moved away from the control tower along with the truck 1. In the embodiment shown in truck 20 is coupled with the truck 1 by a coupling 20*a*. In such an arrangement the connections 7 and 8 may comprise rigid pipeline connections 7*c* and 8*a*. In this embodiment the supply line 19 for the inert gases may be selectively connected to individual connecting lines 19*a* or 19*b* supplied from a supply line 29 for the inert gases when the coupled trucks 20 and 1 are moved to the vicinity of the tower 23.

What is claimed is:

1. An apparatus for supplying predried fine coal to individual ovens of a coke-oven battery, comprising a support truck adapted to be moved along the coke oven battery, a fine coal hopper mounted on said support truck and having a discharge for the discharge of the fine coal into the individual coke ovens, inert gas pressure storage means, an inert gas distributor located adjacent said hopper and connected into said hopper at spaced locations around its periphery and along its height and having means for discharging gas into said hopper at such locations, and connection means between said inert gas distributor and said inert gas pressure storage means permitting movement of said hopper with said support truck along the coke oven batteries.

2. An apparatus according to claim 1 including a gas distributing nozzle at each of the connections inside said hopper for distributing gases through the fine coal therein.

3. An apparatus according to claim 1 wherein said distributor includes a plurality of ring conduits extending around said hopper at spaced vertical locations along its height, and a plurality of connecting lines extending from said ring conduits radially into said hopper, terminating in discharges in said hopper, and means for said distributing lines for regulating the pressure of inert gases passing therethrough.

4. An apparatus according to claim 1 wherein said inert gas pressure storage means is mounted for movement along with said truck.

5. An apparatus according to claim 4 including a separate support carriage carrying said inert gas pressure storage means and means coupling said carriage to said truck.

6. An apparatus according to claim 1 including a hood extending over said hopper having a gas drain connection and inert gas return line connected between said inert gas pressure storage means and said gas drain of said hood, said inert gas pressure storage means including filter means connected to said inert gas return line, a compressor having a discharge, a pressure storage tank connected to the discharge of said compressor, means for removing cleaned inert gases from said filter and directing them to said compressor.

7. An apparatus according to claim 6 including a screw conveyor connected to the discharge of said filter and to said pressure storage tank for removing solids therefrom.

8. An apparatus according to claim 6 wherein said inert gas pressure storage means comprises a fixed station and said inert gas return line is connected from said hopper to said fixed station, said return line and said inert gas feed line comprising flexible connections.

9. An apparatus according to claim 8 including a wheeled carriage movable along the coke ovens and having a drum thereon over which the flexible connections are movable, said carriage being movable to take up the slack between the flexible connections and said support truck.

* * * * *